United States Patent [19]

Busby et al.

[11] 4,418,254

[45] Nov. 29, 1983

[54] ONE PIECE OPERATOR FOR ELECTRIC SWITCH HAVING PIVOTING AND SLIDING CONTACTOR

[75] Inventors: Robert A. Busby; Gursharan P. S. Nat; John W. Stearley, all of Smithfield, N.C.

[73] Assignee: Eaton Corporation, Cleveland, Ohio

[21] Appl. No.: 369,061

[22] Filed: Apr. 16, 1982

[51] Int. Cl.[3] ..... H01H 21/42; H01H 13/00

[52] U.S. Cl. ..... 200/68.3; 200/339; 200/275

[58] Field of Search ..... 200/67 G, 60, 339, 315, 200/335, 153 G, 153 H, 275

[56] References Cited

U.S. PATENT DOCUMENTS

| | | | |
|---|---|---|---|
| 1,777,330 | 10/1930 | Seuffert | 200/68 |
| 2,399,462 | 4/1946 | Bryant | 200/68 |
| 3,158,704 | 11/1964 | Sorenson | 200/67 G |
| 3,330,930 | 7/1967 | Hill et al. | 200/243 |
| 3,403,236 | 9/1968 | Zoludow | 200/67 G |
| 3,711,663 | 1/1973 | Sorenson | 200/67 G |
| 4,127,754 | 11/1978 | Josemans et al. | 200/67 G |
| 4,170,725 | 10/1979 | Farrell | 200/67 G |
| 4,314,121 | 2/1982 | Gaber | 200/67 G |

*Primary Examiner*—James E. Byrant, III
*Assistant Examiner*—Ernest G. Cusick
*Attorney, Agent, or Firm*—C. H. Grace; L. G. Vande Sande

[57] ABSTRACT

A pivoted operator d(4) for an electric switch has an inwardly extending actuating leg (4*d*) having direct connection with a contactor (12) to provide over-center pivoting and sliding motion for the contactor. The inner end of the actuating leg has a first slot (4*f*) wherein the actuator leg straddles the contactor and has grooved (4*h*) interior surfaces which receive outward lateral projections (12*a*) on the contactor for affecting a driving connection therebetween. The depending leg has a cylindrical recess (4*e*) which receives a helical compression spring (14) to bear between the operator and the contactor. Transversely aligned connection points (12*a*, 4*h*) actuator and contactor and the edges of the slot (4*f*) in the actuator cooperating with the lateral edges of the contactor (12) guide the latter throughout its longitudinal movement to prevent angular displacement in a horizontal plane of the contactor within the switch.

5 Claims, 4 Drawing Figures

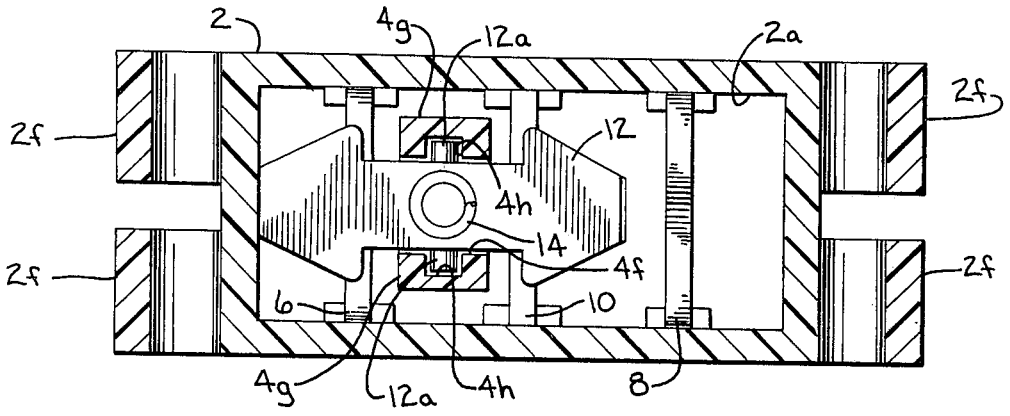
FIG.3
FIG.4
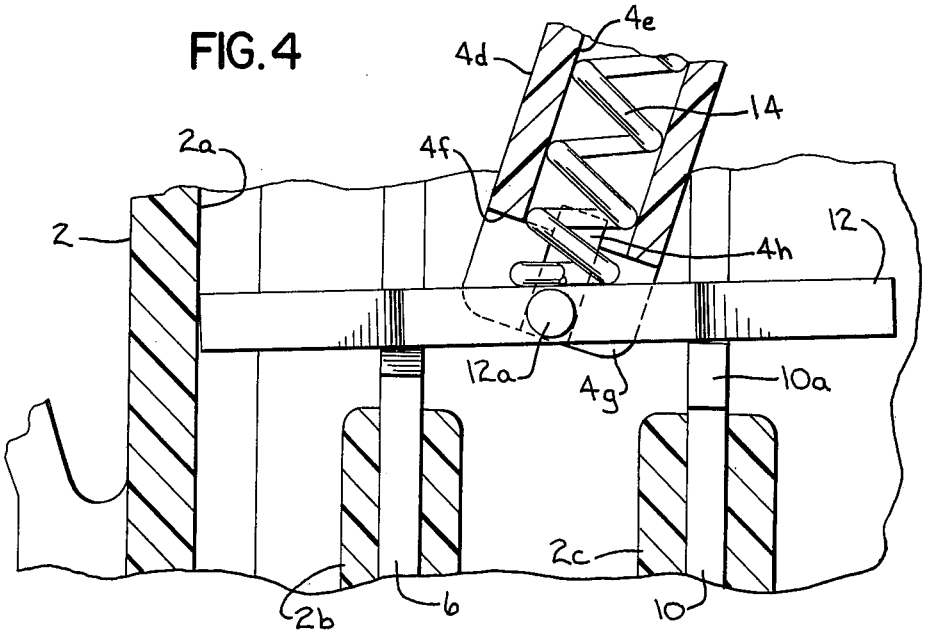

ONE PIECE OPERATOR FOR ELECTRIC SWITCH HAVING PIVOTING AND SLIDING CONTACTOR

BACKGROUND OF THE INVENTION

U.S. Pat. No. 4,127,754 issued Nov. 28, 1978 to L. J. Josemans et al and assigned by mesne Assignments to the Assignee herein, discloses an electric switch having a rocker button operator and a pivoting and sliding contactor. The connection between the operator and the contactor is provided by a plunger situated within a blind hole in the operator and biased outwardly of the operator against the contactor by a compression spring. The plunger engages the contactor at opposite lateral depressions thereof to provide a driving connection for sliding and pivoting movement of the contactor and to afford limited, resilient guiding for the contactor against skewing or window locking within the switch housing cavity. Switches of this type are designed to primarily meet the requirements of a low cost, high quantity market. Accordingly it is important that such switch designs utilize as few parts as possibile in order to reduce manufacturing and assembly costs.

SUMMARY OF THE INVENTION

The electric switch provided in this invention reduces the number of parts and the cost thereof to be more economically manufactured and marketed. This switch provides a one piece operator which connects directly with the pivoted and sliding contactor, thereby eliminating the separate plunger present in existing switches of this type. The switch operator contains a blind hole in which a helical compression spring is received to bear directly upon the surface of the contactor within the area of engagement therewith by the operator, thereby providing the needed spring pressure for over center operation and contact pressure. The switch further provides an operator which engages the contactor at laterally opposite sides thereof for positively guiding the contactor in its movement from one switch operating position to another to prevent skewing the actuator within the switch cavity which might cause window locking of the contactor within the switch.

BRIEF DESCRIPTION OF THE DRAWINGS

FIG. 3 is a horizontal cross sectional view taken along the line 3—3 in FIG. 1; and FIG. 4 is a fragmentary sectional view illustrating the connection between the operator and contactor of the switch shown in FIGS. 1 to 3.

DESCRIPTION OF THE PREFERRED EMBODIMENTS

The switch of this invention comprises a molded insulating housing 2 having a cavity 2*a* open to the top side thereof. The bottom wall of the housing is provided with three upstanding bosses 2*b*, 2*c* and 2*d*. Each of these bosses has a rectangular aperture therethrough communicating between the exterior bottom of the housing 2 and the interior of cavity of 2*a*. The side walls of the switch cavity 2*a* are provided with grooves which are in transverse alignment with the apertures through the respective bosses 2*b*, 2*c* and 2*d*. A flange 2*e* is formed around the exterior top of the switch housing 2. Pairs of upstanding arms 2*f* are integrally molded with the switch housing 2 at the lower corners of the opposite ends of the housing. The arms 2*f* project upwardly and outwardly of the housing and their free ends terminate just below the underside of flange 2*e*. *The free ends of arms 2f* are provided with serrations 2*g* on their outer surfaces. The arms 2*f* and the flange 2*e* cooperate to mount the switch to a panel when the switch is inserted into an opening in the panel. Such insertion causes the arms 2*f* to be compressed against the ends of the switch housing until the underside of flange 2*e* abuts the forward surface of the panel. The arms 2*f* resiliently project outwardly of the ends of the housing and the serrations 2*g* engage with the under surface of the panel to securely hold the switch to the panel.

Figure 2:
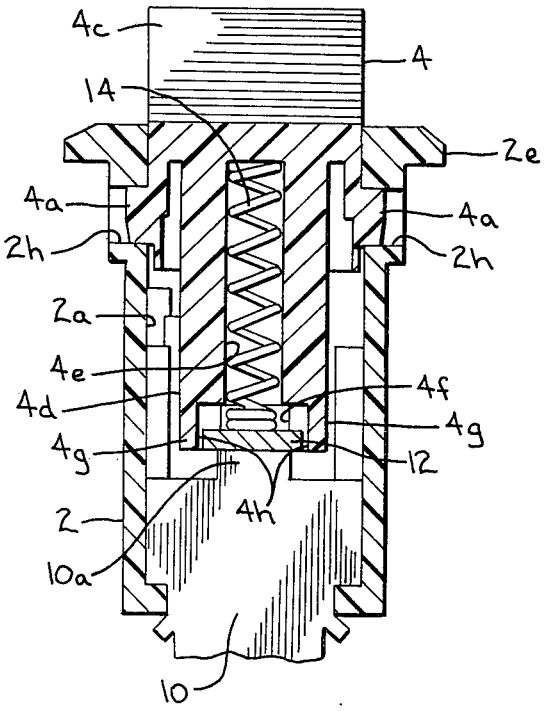
FIG. 2 is a transverse sectional view taken substantially along the line 2—2 in FIG. 1.

A switch operator 4, which may be a rocker as shown in the drawings or may be a lever as alternatively shown in the aforementioned U.S. Pat. No. 4,127,754, has a pair of trunnions 4*a* molded integrally on opposite side to be received within circular apertures 2*h* in the side walls of housing 2. As seen in FIG. 2, the lower halves of the trunnions 4*a* are beveled inwardly to facilitate the insertion of operator 4 into the cavity of 2*a* of housing 2, such insertion deflecting the side walls outwardly until the trunnions 4*a* align with and snap into the apertures 2*h*. The upper surface of rocker 4 is provided with right and left hand portions 4*b* and 4*c*, respectively, which are joined together at the center and extend outwardly in a V-shape with respect to one another to provide one inclined surface and one flush surface of the operator with respect to the top of the switch housing. A depending actuator leg 4*d* is formed integrally with the operator 4 and contains a cylindrical recess 4*e* which is closed at its upper end and open to the lower end of actuator leg 4*d*.

Figure 1:
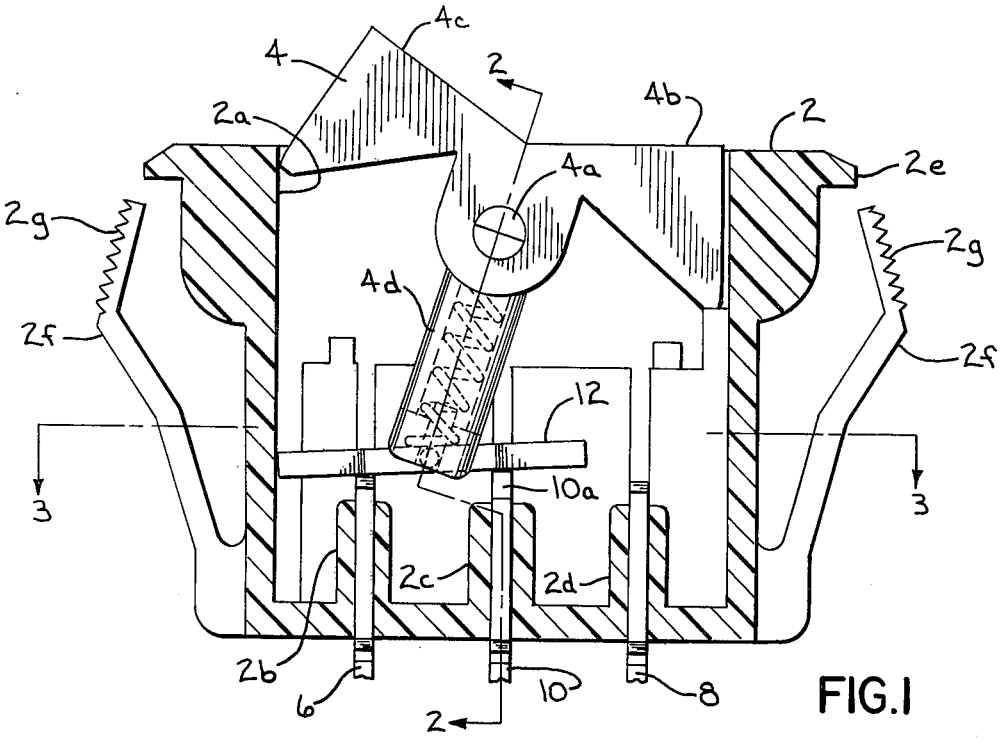
FIG. 1 is a longitudinal sectional view of an electric switch having a one piece operator connected directly to a pivoting and sliding contactor.

A pair of electrically conductive terminal members 6 and 8 are inserted within the rectangular apertures of bosses 2*b* and 2*d*, respectively. Terminal members 6 and 8 are formed identically and are essentially flat blade members having a reduced lower section to provide shoulders which seat against the bottom of the aperture within the respective boss 2*b* or 2*d* of the housing 2. The terminal members 6 and 8 are secured within the housing 2 by staking the terminals along the bottom exterior surface of the housing 2. The upper edges of terminals 6 and 8 are arcuately formed in a convex shape to provide stationary contact surfaces for the switch. A center terminal 10 is provided in the central upstanding boss 2*c* in a manner similar to terminals 6 and 8. The upper end of center terminal 10 is provided with a reduced width upstanding contact portion 10*a* which is substantially rectangular in shape as seen in FIGS. 1 and 2. The upper surface of contact portion 10*a* lies above the horizontal plane containing the upper surfaces of the stationary contacts 6 and 8.

A contactor 12 made of electrically conductive material is disposed over the contacts 6, 8, and 10 within the cavity 2*a* of housing 2 and is movable longitudinally within the cavity to alternately bridge the left stationary contact 6 and center contact 10 or the center contact 10 and right stationary contact 8. As best seen in FIGS. 3 and 4, contactor 12 is provided with a pair of transversely extending lateral projections 12*a* in the form of cylindrical pins formed integrally therewith. The width of the central portion of contactor 12 between the pins 12*a* is slightly greater than the width of the upstanding contact portion 10*a* of center terminal 10. The lower end of actuator leg 4*d* has a slot 4*f* formed therein in the longitudinal direction of contactor movement to provide separate opposite sides 4*g* of the leg which straddle the center portion of contactor 12. The interior surface of each side 4*g* is provided with a transversely aligned, vertically extending recesses or grooves 4*h* in which the respective pins 12*a* of contactor 12 are disposed to provide a driving connection between the actuator leg and the contactor. A helical compression spring 14 is disposed within the cylindrical recess 4*e* to bear against the upper, closed end of that recess and the upper surface of contactor 12.

The switch as shown in the drawings is a two position switch bridging either outer terminal 6 or 8 with common center terminal 10. To operate the switch from the position shown in FIG. 1, the left hand side 4*c* of operator 4 is depressed to cause the operator to pivot about trunnions 4*a* in a counter-clockwise direction. This movement carries the lower end of actuator leg 4*d* across the plane of center terminal 10, thereby carrying contactor 12 to the right. As the actuator leg 4*d* approaches the vertical plane of the center terminal 10, the pins 12*a* ride upwardly in the grooves 4*h* thereby compressing spring 14. Continued movement of operator 4 carries the lower end of actuator leg 4*d* across the plane of center terminal 10 whereupon the radial length between the pivot axis of trunnions 4*a* and the center of pins 12*a* increases and the spring 14 operates to expand and cause the contactor 12 to snap from one position to another in a well known over-center manner. The contactor slides along the upper surface of contact portion 10*a* and upper portion of contact 6 until such time as the pin 12*a* crosses the vertical plane of center terminal 10. At that point, the right-hand end of contactor 12 is disposed above the upper end of right-hand contact 8. As the pins 12*a* cross over the center plane, the right-hand end of contactor 12 pivots downwardly into engagement with right-hand stationary terminal 8 and the left-hand end of contactor 12 pivots upwardly out of engagement with left-hand stationary contact 6. As the motion of the operator 4 continues to its extreme position, the contactor 12 slides along the upper surfaces of contact portion 10*a* and right-hand stationary contact 8 to provide a wiping action between the contacts. The transverse points of engagement of the lateral edges of contactor 12 with opposite sides 4*g* of slot 4*f* provide lateral support for the contactor 12 as it is slid longitudinally within the switch housing, and prevents the contactor from being angularly displaced in a horizontal plane, or skewing, which could cause the contactor to stub against portions of the side wall of the cavity 2*a* and could tend to cause window blocking of the contactor within the housing.

The switch as provided herein completely eliminates a plunger member commonly found in over-center contactor mechanisms, and provides a connection with the contactor whereby a compression spring contained within the operator bears directly and captively upon the surface of the contactor without the need of an upstanding projection of the contactor to retain or position the spring. The point of engagement between the actuator leg and the contactor is made at transversely opposite sides to provide guidance for the contactor as it is moved from one operating position to another. The lower end of the actuator leg is also slotted to extend along opposite sides of the contactor and thereby provide further guidance for the contactor against angular displacement in the horizontal plane while moving from one operating position to another. While a preferred embodiment of the electrical switch having a one piece operator for a pivoting and sliding contactor has been disclosed herein, it is to be understood that the invention is susceptible of various modifications without departing from the scope of the amended claims.

We claim:

1. An electric switch comprising in combination:

a housing;

a pair of contact terminals spaced apart in said housing;

a third terminal mounted between said contact terminals in said housing, said third terminal having a contact portion centrally located and substantially narrower in width than the remainder of that terminal and extending above said contact terminals;

a movable contactor of a width greater than said contact portion of said third terminal cooperating with said terminals to complete electrical circuits between said contact portion of said third terminal and either of said contact terminals, said contactor having lateral projections intermediate its ends;

an operator pivotally mounted in said housing and having a portion exteriorly of said housing which is engageable to effect pivoting thereof, said operator having a contactor actuating leg extending interiorly of said housing and having a slot in an end thereof defining spaced end portions, said actuator leg straddling said contactor with said spaced end portions extending along lateral edges of said contactor, recesses in each said spaced end portion engaging said lateral projections to provide a driving connection for sliding movement of said contactor while affording free pivoting of the latter therein, said actuating leg being pivotally movable by said operator to pivot said contactor on the contact portion of said third terminal and to slide it thereon into engagement with either of said contact terminals; and spring means carried by said actuating leg for biasing said contactor into engagement with the contact portion of said third terminal.

2. The invention defined in claim 1 wherein said recesses are upwardly extending grooves having their open sides facing each other.

3. The invention defined in claim 2 wherein said spaced end portions are closely adjacent said lateral edges of said contactor to restrict pivotal movement of said contactor in a horizontal plane.

4. The invention defined in claim 3 wherein said actuating leg has a recess extending upwardly from said slot and said spring means is disposed within said last mentioned recess.

5. The invention defined in claim 4 wherein said recess is a cylindrical bore closed at an upper end thereof and said spring means is a helically wound compression spring, one end of which rests on a top surface of said contactor and is restrained against lateral displacement on that surface by said spaced end portions of said actuating leg.

* * * * *